US006419051B2

(12) United States Patent
Mori et al.

(10) Patent No.: US 6,419,051 B2
(45) Date of Patent: Jul. 16, 2002

(54) CONTROL SYSTEM AND CONTROL METHOD FOR REASSIGNING THE CARS OF A DOUBLE-DECK ELEVATOR

(75) Inventors: Toshimitsu Mori, Hadano (JP); Zuhair Bahjat, Farmington, CT (US); Jannah Stanley, Cromwell, CT (US); Mark Ross, Shelton, CT (US); Masanori Sahara, Kanagawa-ken; Hideyuki Honma, Kanagawa, both of (JP)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 09/835,425

(22) Filed: Apr. 16, 2001

(30) Foreign Application Priority Data

Apr. 19, 2000 (JP) ..... 2000-117332

(51) Int. Cl.[7] ..... B66B 1/18
(52) U.S. Cl. ..... 187/382; 187/902; 187/247
(58) Field of Search ..... 187/380, 382, 187/383, 385, 387, 902, 281, 247

(56) References Cited

U.S. PATENT DOCUMENTS 4,993,518 A * 2/1991 van Straaten et al. ..... 187/127
5,625,176 A * 4/1997 Davis et al. ..... 187/393
5,844,179 A * 12/1998 Walker et al. ..... 187/382
5,861,587 A * 1/1999 Powell et al. ..... 187/382
6,176,351 B1 * 1/2001 Ikede et al. ..... 187/387
6,237,721 B1 * 5/2001 Siikonen ..... 187/382
6,293,368 B1 * 9/2001 Ylinen et al. ..... 187/382

FOREIGN PATENT DOCUMENTS

JP 2000-327237 11/2000 ..... B66B/1/18

* cited by examiner

*Primary Examiner*—Jonathan Salata

(57) ABSTRACT

A control device for a double-deck elevator system having an upper deck and a lower deck, includes a group control device for assigning the upper and lower decks to respond to car calls from the upper and lower decks and boarding hall calls from a plurality of floors. The control device further includes an assignment control device for determining whether a plurality of the car calls and boarding hall calls can be responded to simultaneously and for directing said group control device to reassign the upper and lower decks to respond to the plurality of car calls and boarding hall calls simultaneously.

8 Claims, 5 Drawing Sheets

△ UP BOARDING HALL CALL
▽ DOWN BOARDING HALL CALL
△ NEW UP BOARDING HALL CALL
▽ NEW DOWN BOARDING HALL CALL
△ TOP DECK RESPONSE UP BOARDING HALL CALL
△ BOTTOM DECK RESPONSE UP BOARDING HALL CALL
▽ TOP DECK RESPONSE DOWN BOARDING HALL CALL
▽ BOTTOM DECK RESPONSE DOWN BOARDING HALL CALL
○ TOP DECK CAR CALL
○ BOTTOM DECK CAR CALL

FIG.3a
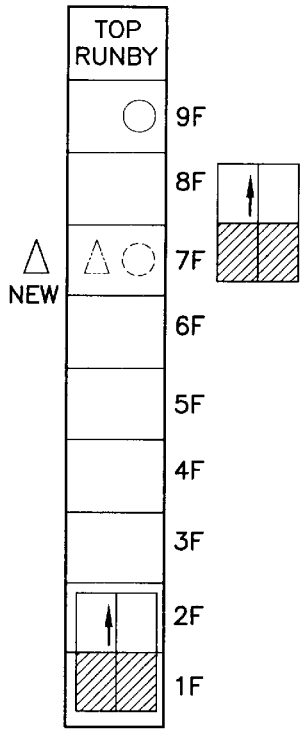
FIG.3b
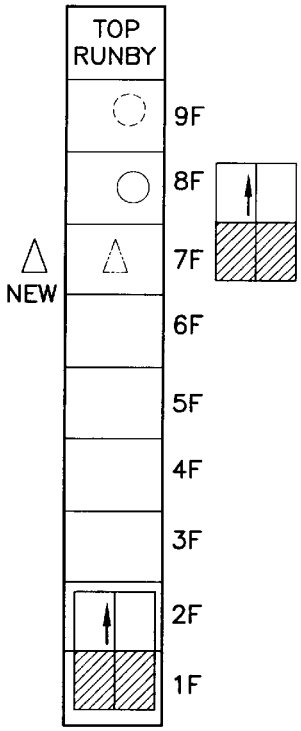
FIG.3c
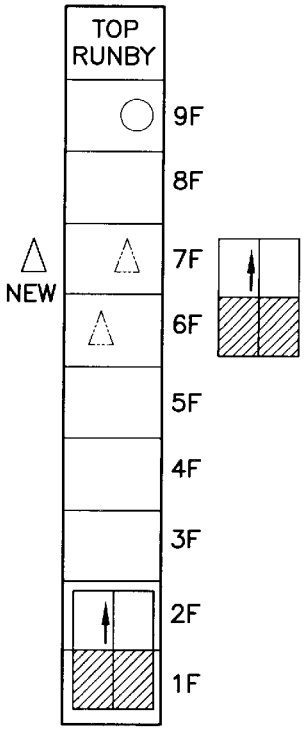
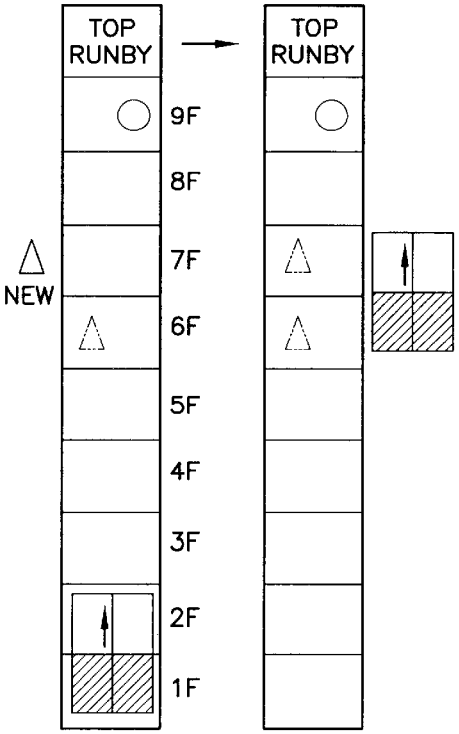
FIG.3d
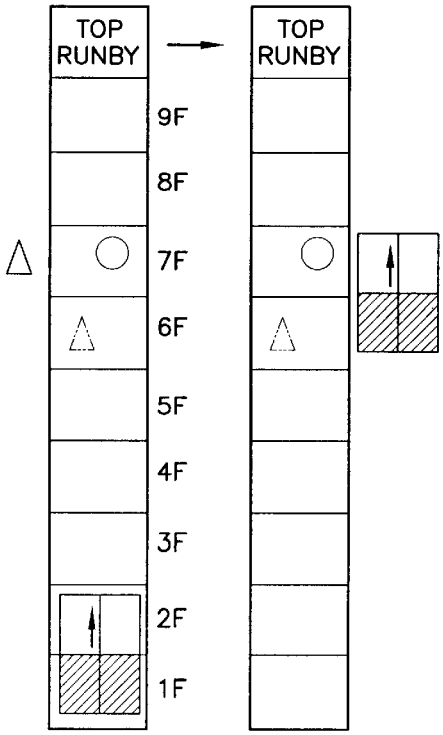
FIG.3e △ UP BOARDING HALL CALL
▽ DOWN BOARDING HALL CALL
△ NEW UP BOARDING HALL CALL
▽ NEW DOWN BOARDING HALL CALL
△ TOP DECK RESPONSE UP BOARDING HALL CALL
△ BOTTOM DECK RESPONSE UP BOARDING HALL CALL
▽ TOP DECK RESPONSE DOWN BOARDING HALL CALL
▽ BOTTOM DECK RESPONSE DOWN BOARDING HALL CALL
○ TOP DECK CAR CALL
○ BOTTOM DECK CAR CALL

CONTROL SYSTEM AND CONTROL METHOD FOR REASSIGNING THE CARS OF A DOUBLE-DECK ELEVATOR

FIELD OF INVENTION

The present invention pertains to a control device and a control method for a double-deck elevator system that has an upper deck and a lower deck conveyed simultaneously to two adjacent floors.

BACKGROUND OF INVENTION

Conventional double-deck elevator systems can convey a very large number of passengers to the target floors with fewer stops than single-deck elevator systems and are used in skyscrapers and high-capacity buildings.

Double-deck elevator systems are furnished with a plurality of elevators that have an upper deck and a lower deck. A group management and control unit collects information, e.g., car (elevator car) position, direction of travel, car calls, and boarding hall calls via an elevator controller furnished for each elevator and outputs all control instructions based on this information to each elevator via each of the aforementioned elevator controllers.

The aforementioned car call input for the destination is provided by the passenger using some means, e.g., a control panel furnished for each deck of the double-deck elevator. Passengers who board press buttons for target floors on this control panel, the destination information for the passengers on each deck of the elevator is transmitted to the elevator controller.

A boarding hall call is provided from the elevator call panel placed near the door in an elevator boarding hall. The elevator call panel includes an ascending call button and a descending call button. A passenger that calls an elevator presses the button for the desired direction, and after boarding the called elevator, inputs the destination floor on the car operating panel.

In group control in existing double-deck elevators, during peak times, e.g., at the start of the workday or during lunch, for operation from the lobby or other designated high traffic area, a skip operation is often used to increase carrying capacity whereby the lower decks respond to both boarding hall calls and car calls on even-numbered floors. The upper decks respond to both boarding hall calls and car calls on odd-numbered floors. Stairs must be used by passengers to go from even to odd numbered floors and vice versa.

For times other than peak operation or in buildings in which it would be difficult to use the stairs, there is a method (unlimited operation) in which the responding deck is not limited to odd-numbered or even-numbered floors. Either deck can respond to all floors. In the past, a leading deck method or trailing deck method would have been used as the method of boarding hall call assignment in this unrestricted operation.

In a leading deck method of responding to boarding hall calls, the first deck relative to the direction of travel responds to hall calls. The upper deck responds to up boarding hall calls and the lower deck responds to down boarding hall calls.

In a trailing deck method of responding to boarding hall calls the second deck relative to the direction of travel responds to boarding hall calls. The lower deck responds to up boarding hall calls and the upper deck responds to down boarding hall calls.

In the aforementioned deck assignment operation for peak times, there are fewer stops, so that the cycle time is short and the carrying capacity from a reference floor, e.g., a lobby, or to the reference floor is improved. Conversely, however, it is difficult to move between general floors (for example, moving between an odd-numbered floor and an even-numbered floor, such as from the third floor to the eighth floor), and it is also necessary to use the stairs. For this reason, the placement of stairs in buildings must also be near the elevators.

In the aforementioned leading deck method and trailing deck method, there are no restrictions on the odd-numbered floors or even-numbered floors, and it is possible to move between general floors without using the stairs. Conversely, the disadvantages are that the number of stops increases, either of the decks may be operated without passengers, so that the operating efficiency will be poor, and they are not used to full advantage as double decks.

Normally, there is the concern that changing the assignment of boarding hall calls will confuse users, so that there are many restrictions. Particularly in an immediate reservation system (system in which the elevator responding to a boarding hall call is assigned immediately), there are the restrictions that the number of assignment changes is limited and that they are performed only if they result in significantly improved response time.

Double-deck elevator systems also have the same restrictions, and changes in boarding hall call assignment are generally performed cautiously. For this reason, if there were multiple boarding hall calls, the boarding hall calls would be assigned to allow the most efficient response at the time the call is entered and it would be difficult to change the assignment.

The present invention was devised in consideration of the aforementioned situation. It provides a control device and control method for double-deck elevator systems for servicing boarding hall calls and car calls with the fewest stops possible by assigning decks that can respond both to multiple car calls and boarding hall calls, while at the same time, by selecting and assigning the most suitable deck from all the decks of a plurality of elevators according to the boarding hall calls, will make elevator travel and passenger carrying more efficient.

SUMMARY OF INVENTION

In view of the foregoing disadvantages inherent in the conventional methods and systems in the prior art, the present invention provides for a control device and control method for double-deck elevator systems that have an upper deck and a lower deck that are conveyed simultaneously to two adjacent floors, wherein the control device assigns decks to respond to car calls on each of the aforementioned decks and/or to boarding hall calls from each floor. An assignment control means is provided that determines whether it is possible to respond to a plurality of the aforementioned car calls and boarding hall calls simultaneously, and when they can be responded to simultaneously, the aforementioned deck assignments to the boarding hall calls are changed.

In another embodiment of the subject invention a control device and control method for a double-deck elevator system equipped with a plurality of elevators that have an upper deck and a lower deck that are conveyed simultaneously to two adjacent floors wherein the control device assigns elevator decks to respond to boarding hall calls from each floor, an assignment control means is provided that determines the response suitability for all the decks based on, the predicted response time by a deck to the boarding hall call, the likelihood ratio of said predicted response time, the effect on existing boarding hall calls by responding to the aforementioned boarding hall call, the car space available for said deck, and the number of elevators responding to the aforementioned boarding hall call, and assigns the most appropriate deck to respond to boarding hall calls from each of the aforementioned floors based on the determined response suitability, and the aforementioned assignment control means is characterized by the fact that it has a weighting function that weights each of the aforementioned data elements according to priority.

BRIEF DESCRIPTION OF THE DRAWINGS

FIG. 3 is a diagram of the operation of a double-deck elevator according to the present invention.

DETAILED DESCRIPTION OF THE INVENTION

Figure 1:
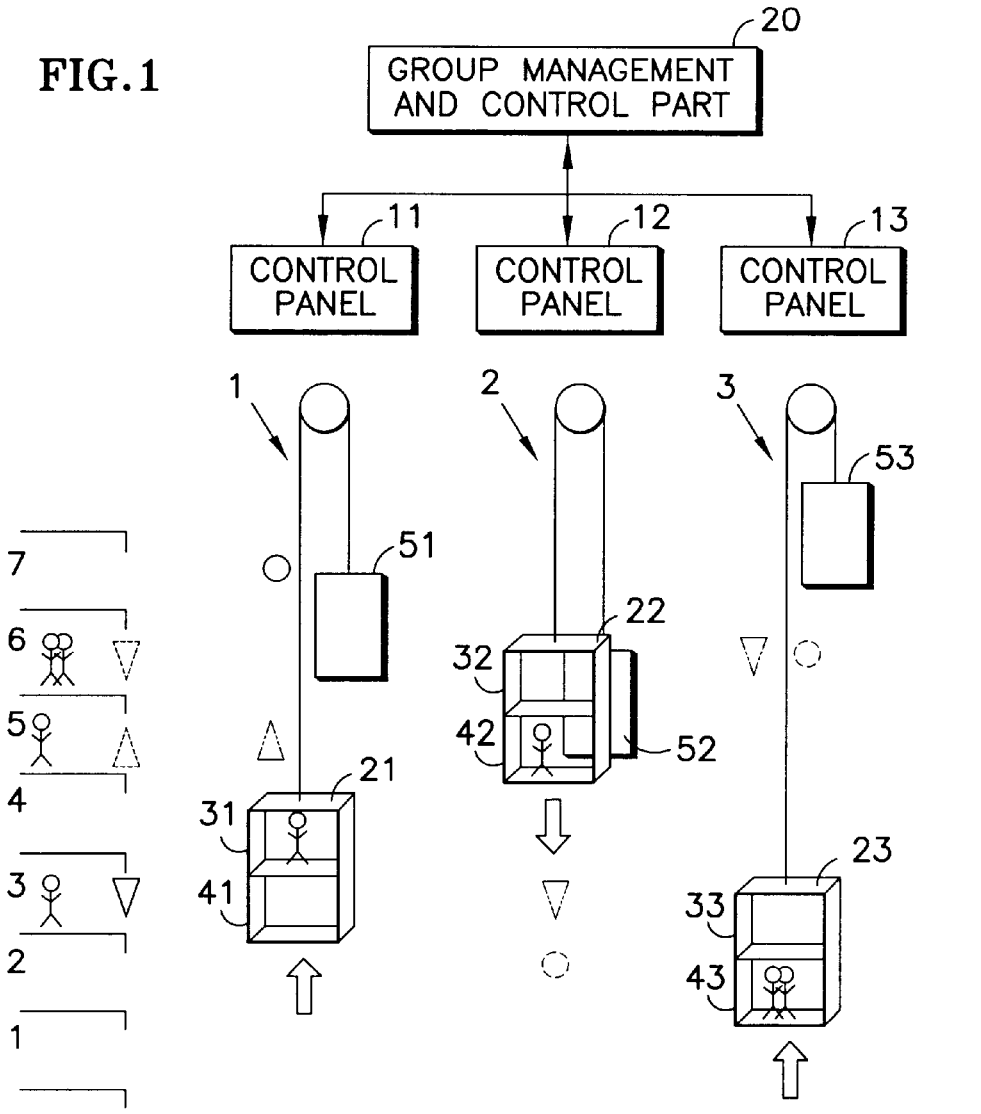
FIG. 1 is a block diagram of a double-deck elevator system according to a first embodiment of the present invention.

A first embodiment of the subject invention is shown in FIG. 1. Double-deck elevators (1), (2), and (3) are located side by side. Each elevator (1), (2), and (3) has a car (21), (22), (23), with an upper deck (31), (32), (33) and a lower deck (41), (42), (43), as shown. Said cars (21), (22), (23) are constituted to move up and down to the target floor driven by a motor (not shown) while its weight is balanced with a counterbalance (51), (52), (53) via a sheave (61), (62), (63) and rope (71), (72), (73).

Control panels (11), (12), and (13) for controlling each elevator are furnished for each elevator (1), (2), and (3). A group management and control part (20) controls the assignment of all cars of each elevator (1), (2) and (3). This group management and control part (20) provides instructions for assigning boarding hall calls and for determining the elevator standby position.

The group management and control part (20) collects car position, direction, door state, and car call information from control panels (11), (12), and (13) of each elevator (1), (2), and (3), determines assignments for decks when new boarding hall calls occur. The group management and control part (20) then transmits the assignment instruction for a deck to the elevator that has that deck. In addition, it continually adjusts boarding hall calls between decks and optimizes boarding hall call assignment in order to operate efficiently.

The group management and control part (20) has an assignment control means (100) composed of a computer or processor, for example, and assigns decks with said assignment control means. The boarding hall call assignment optimization process for changing deck assignments is shown in FIG. 2.

Figure 2:
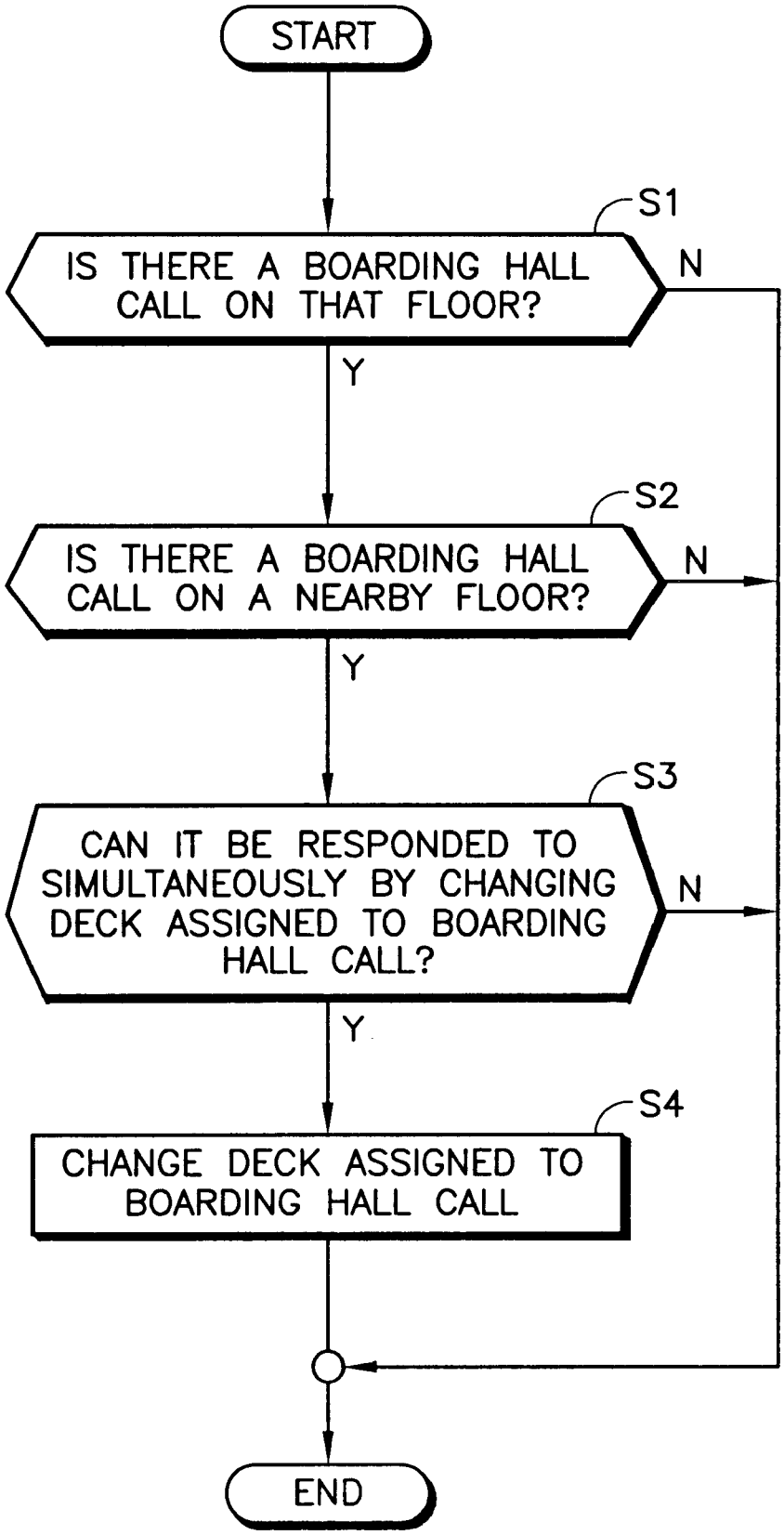
FIG. 2 is a flowchart of the method according to the first embodiment of the present invention.

In FIG. 2, at S1, it is determined whether there is a boarding hall call for a specific floor. When there is a boarding hall call, it is determined whether there is a boarding hall call or car call for a nearby floor at step S2. Then, if there are both boarding hall calls and car calls for nearby floors, it is determined whether it is possible to respond simultaneously to the aforementioned multiple calls by changing the boarding hall call assignment at step S3 (determination processing).

When the result is that it is possible to respond simultaneously, the boarding hall call assignment is changed at step S4 (assignment processing) for the decks to respond simultaneously and processing is complete. Note that when the result of each determination in steps S1–S3 is "no," this process is completed.

Referring again to FIG. 1 the boarding hall call assignment optimization process is explained.

In FIG. 1, the solid-line isosceles triangle pointing up represents a new up boarding hall call. The solid-line isosceles triangle pointing down represents a new down boarding hall call. The dashed-line isosceles triangle pointing up represents an up boarding hall call. The dashed-line isosceles triangle pointing down represents a down boarding hall call. The single dotted-line isosceles triangle pointing up represents a top deck response up boarding hall call. The double dotted-line isosceles triangle pointing up represents a bottom deck response up boarding hall call. The single dotted line isosceles triangle pointing down represents a top deck response down boarding hall call. The double dotted line isosceles triangle pointing down represents a bottom deck response down boarding hall call. The solid-line circle represents a top deck car call, and the dashed-line circle represents a bottom deck car call.

In FIG. 1 elevator (1) is ascending near floors 3 and 4, with a car call to floor 7 on the top deck; elevator (2) is descending near floors 5 and 6, with a car call to floor 2 on the bottom deck; and elevator (3) is ascending near floors 2 and 3, with a car call to floor 6 on the bottom deck.

The information for the situation described above is held by group management and control part (20), deck assignments are determined as follows based on all the information, and deck assignment instructions for said decks are transmitted as follows.

For an up boarding hall call (the dashed-line isosceles triangle pointing up) on floor 5, elevator (2) is descending to answer a car call to floor 2, so that elevator (2) cannot be assigned to the call. Elevators (1) and (3) both ascend to answer car calls, but the distance to floor 5 is shorter (it can arrive faster) for elevator (1) than for elevator (3), so that the top deck of elevator (1) can be assigned (top deck response up boarding hall call) in response to calls represented by the single dotted-line isosceles triangle pointing up.

For a down boarding hall call (dashed-line isosceles triangle pointing down) on floor 6, elevator (2) has already descended near floor 5 and floor 6, therefore elevator (2) cannot be assigned to answer the call. Elevator (1) and elevator (3) are ascending toward floor 6, but despite the fact that the distance to floor 6 is shorter for elevator (1) than for elevator (3), it already has a car call on floor 7 on the top deck and it must answer an up boarding hall call on floor 5 on the way, so it cannot arrive directly at floor 6. In contrast, regardless of the fact that the distance to floor 6 is farther for elevator (3) than for elevator (1), it responds to a car call on floor 6 on the bottom deck, so it can arrive at floor 6 directly. Thus, the bottom deck of elevator (3) is assigned to respond to the call represented by the double dotted line isosceles triangle pointing down (bottom deck response down boarding hall call).

A new down boarding hall request (solid-line isosceles triangle pointing down) is entered on floor 3. Since elevator (1) and elevator (3) are ascending to answer car calls, elevator (1) or elevator (3) cannot be assigned to the call.

Elevator (2) is descending to respond to the bottom deck car call to floor 2 and can respond with the top deck. Thus, the top deck of elevator (2) can be assigned to the call represented by a single dotted line isosceles triangle pointing down (top deck response down boarding hall call).

Next, as shown in FIGS. 3(*a*)–(*e*), it is possible to respond to multiple calls simultaneously by optimizing assignments by changing car assignments. The definitions of the symbols that represent each call in FIGS. 3(*a*)–(*e*) are the same as those in aforementioned FIG. 1.

In FIG. 3(*a*) an up boarding hall call is newly generated on floor 7. The bottom deck of an elevator that has a car call to floor 7 is assigned to the call (this elevator also has a car call to floor 9 on the top deck). The car call and boarding hall call on floor 7 will be answered simultaneously.

In FIG. 3(*b*) an up boarding hall call is newly generated on floor 7. The bottom deck of an elevator that has a car call to floor 8 on the top deck is assigned to the call (this elevator has a car call to floor 6 on the top deck and a car call to floor 9 on the bottom deck). The car call on floor 8 and the boarding hall call on floor 7 will be answered simultaneously.

In FIG. 3(*c*) an up boarding hall call is newly generated on floor 7. The top deck of an elevator that has a boarding hall call for floor 6 on the bottom deck is assigned to the call (this elevator also has a car call to floor 9 on the top deck), and the boarding hall calls on floor 6 and floor 7 will be answered simultaneously.

In FIG. 3(*d*) an up boarding hall call is newly generated on floor 7. The top deck of an elevator that already has a boarding hall call on floor 6 for the top deck is assigned to the call (this elevator also has a car call to floor 9 on the top deck). The aforementioned boarding hall call on floor 6 is changed to the bottom deck (step S4 in FIG. 2) and the boarding hall calls on floor 6 and floor 7 will be answered simultaneously.

In FIG. 3(*e*) a car call to floor 7 is generated on the top deck. In response, the deck assigned to the boarding hall call on floor 6 is changed from the top deck to the bottom deck (step S4 in FIG. 2) and the boarding hall calls on floor 7 and floor 6 will be answered simultaneously.

In the examples of FIG. 3, when assignments to boarding hall calls are determined or when assignments are periodically corrected in a double-deck elevator system, the deck assignments are optimized relative to the top decks and bottom decks, boarding hall calls and car calls can be serviced with the smallest number of stops possible, and operating efficiency can be achieved.

Particularly in an immediate reservation system, when a boarding hall call button is pressed, although the elevator that will respond is indicated promptly, it is not clear in the boarding hall whether the top deck or the bottom deck will arrive. However, the standby position will not change and therefore optimization can occur without user confusion.

By making use of the features of double decks as described above, constantly monitoring car calls and boarding hall calls, and optimizing assignment of boarding hall calls between the top and bottom decks, the elevators can be operated efficiently.

Figure 4:
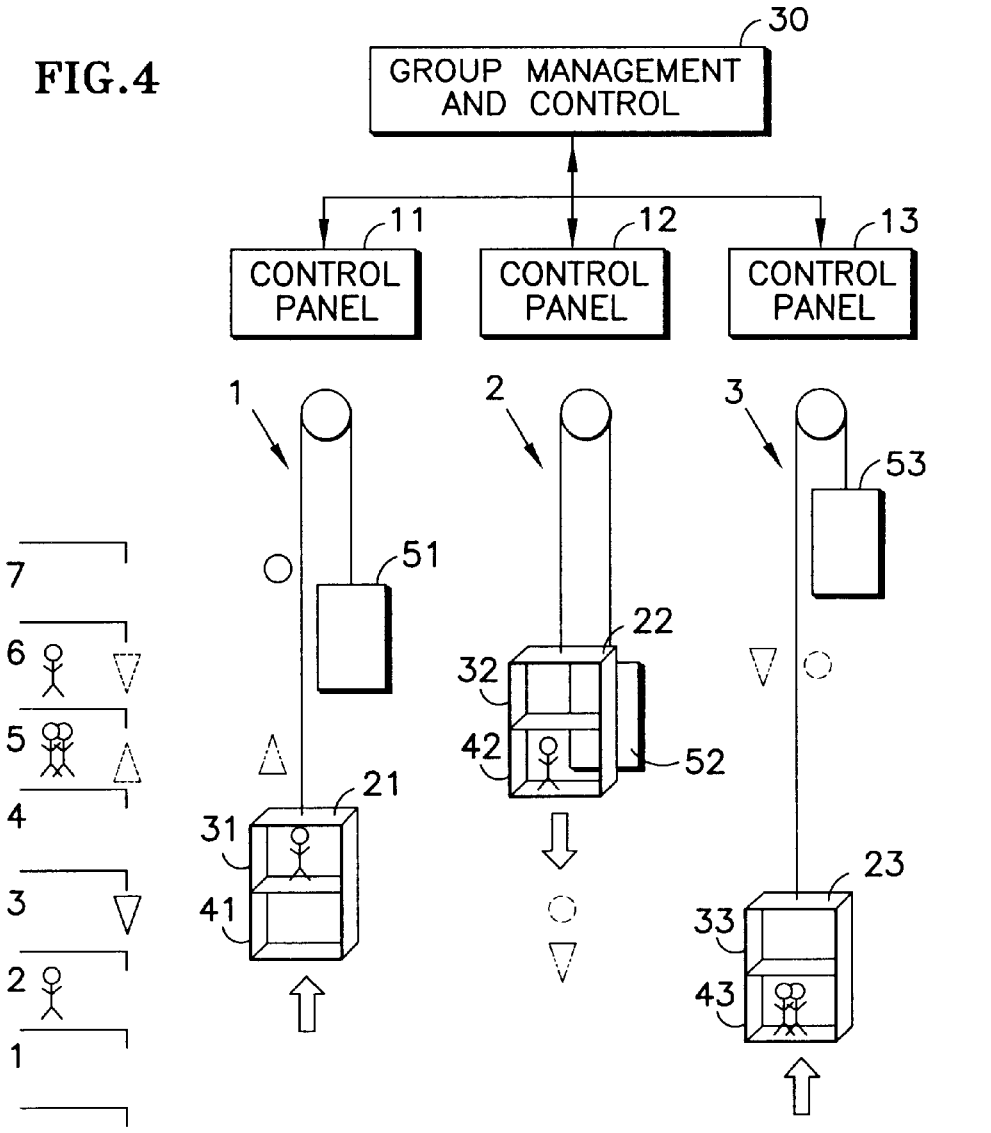
FIG. 4 is a block diagram of a double-deck elevator system according to a second embodiment of the present invention.
Figure 5:
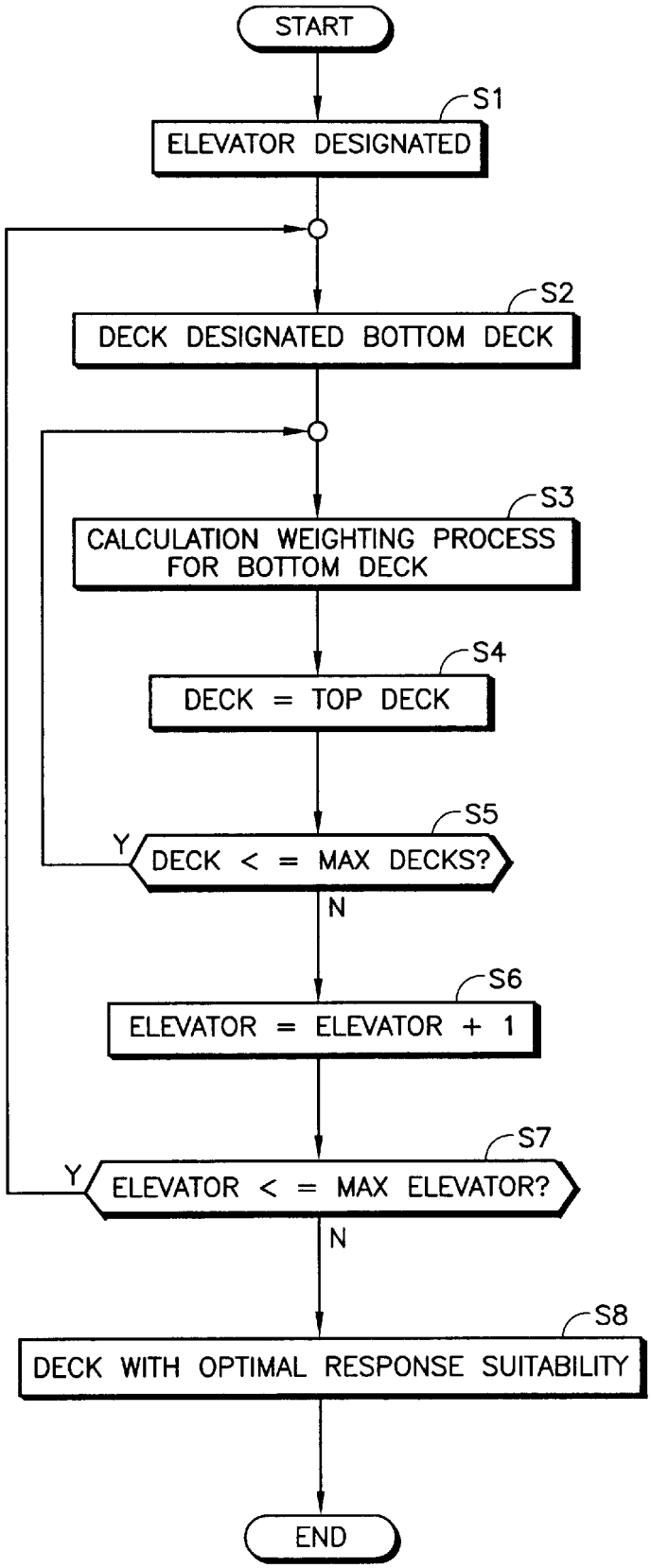
FIG. 5 is a flowchart of the method according to the second embodiment of the present invention.

A second embodiment of the present invention is shown in FIGS. 4 and 5. In FIG. 4, group management and control part (30) replaces group management and control part (20) of FIG. 1. Otherwise, it has the same constitution as FIG. 1.

Group management and control part (30) provides instructions for boarding hall call assignment and elevator standby position when service for boarding hall calls and car calls has been completed. Group management and control part (30) collects the car position, direction, door state, and car call information from control panels (11), (12), and (13) from each elevator (1), (2), and (3), determines deck assignments when new boarding hall calls are generated, and transmits deck assignment instructions to the given elevators.

This group management and control part (30) has an assignment control means composed of a computer, for example. The group control means (30) collects the boarding hall calls and calculates a response suitability index, simultaneously calculated for the top and bottom decks of all elevators with the priority of bottom deck and top deck eliminated, and without the restrictions of odd-numbered floor and even-numbered floors, and the boarding hall call is assigned to the optimum deck. By using both top and bottom decks in this way to respond to boarding hall calls and car calls, elevator movement and passenger transport can be made more efficient.

The response suitability index found by the aforementioned assignment control means is obtained by adding the data elements below, for example.

Response time: whether predicted response time to that boarding hall call is short.

Response time likelihood ratio: whether the predicted response time to that boarding hall call is correct (whether there is any risk of responding to new boarding hall calls or car calls while traveling to the floor where the new call is generated).

Effect on existing calls: will response time to existing boarding hall calls be increased by responding to that call?

Space available in the car: will there already be a large number of passengers when responding to that boarding hall call?

Degree of grouping: Will all the elevators be grouped together in the same vicinity?

Each of these data elements is calculated, the response suitability index of each deck is found, and the new boarding hall call is assigned to the deck with the best value for this index. Thus, elevator operation where both decks are used effectively is possible, and call response and passenger transport can be made more efficient.

A process flow for new boarding hall call assignment performed by the assignment control means of the subject embodiment is illustrated in FIG. 5. In FIG. 5, the car represents the elevator, and the deck represents a top deck or bottom deck.

When a new boarding hall call is generated in a double-deck elevator system with three elevators, as in FIG. 4, for example, first, at step S1 the elevator is designated elevator (1), and at step S2 the deck is designated the bottom deck. Note that each time the processing in Step S2 is performed, the number of decks is initialized to "1," and each time the processing in step S4, discussed below, is performed, a "1" is added to the number of decks (in practice, this is realized using a counter with that type of function).

Next, in step S3 (calculation process, weighting process), each of the aforementioned data elements is calculated for "the bottom deck of elevator (1)" and the response suitability index (Assign Index) is found. That is, the product of the function of the aforementioned response time F1 and weight W1, the product of the function of the aforementioned response time likelihood ratio F2 and weight W2, the product of the function of the aforementioned effect on existing calls F3 and weight W3, the product of the function of the aforementioned space available in the car F4 and weight W4, and the function of the aforementioned degree of grouping F5 and weight W5 are added.

Next at step S4, the deck is designated the top deck, and each time processing in this step S4 is performed, the number of decks is increased one at a time. Then, at step S5 it is determined whether the deck is less than the maximum number of decks. At this point, the number of decks is 2 and it is below the maximum number of decks "2." Thus, the process of aforementioned step S3 is performed again and the response suitability index for "the top deck of elevator (1)" is found.

Next, the process in step S4 is performed. The deck in this case is the top deck, so only the number of decks is incremented by "1," and the number of decks becomes 3. In step S5 the number of decks is 3 and is greater than the maximum number of decks "2," so that next the number of elevators is increased by 1 at step S6 and is designated elevator (2).

Next at step S7, it is determined whether the number of elevators is less than the maximum number of elevators. At this point, the number of elevators is 2 and it is less than the maximum number of elevators "3," so that the process in aforementioned step S2 is performed again and the deck is designated the bottom deck (in this case, the number of decks is initialized to "1").

Next at step S3, processing to find the aforementioned response suitability index for "the bottom deck of elevator (2)" is performed. Then, at step S4, the deck is designated the top deck (the number of decks incremented by 1). At step S5, it is determined whether the number of decks is less than the maximum number of decks. At this point, the number of decks is 2, not greater than the maximum number of decks "2."Thus, the process in aforementioned step S3 is performed again and the response suitability index is found for "the top deck of elevator (2)."

Next, the process in step S4 is performed. The deck in this case is the top deck, so only the number of decks is incremented by "1," so that the number of decks becomes 3. In step S5, the number of decks is 3, greater than the maximum number of decks "2"; next, therefore, the number of elevators is increased by 1 at step S6 and is designated elevator (3).

At step S7, it is determined whether the number of elevators is less than the maximum number of elevators. At this point, the number of elevators is 3 and is not greater than the maximum number of elevators "3," so that the process of the aforementioned step S2 is performed again and the deck is designated the bottom deck (in this case, the number of decks is initialized to "1").

Next, at step S3, processing to find the aforementioned response suitability index for "the bottom deck of elevator (3)" is performed. Then at step S4, the deck is designated the top deck (the number of decks is incremented by 1). At step S5, it is determined whether the number of decks is less than the maximum number of decks. At this point, the number of decks is 2 and it is not greater than the maximum number of decks "2." Thus, the process in aforementioned step S3 is performed again and the response suitability index is found for "the top deck of elevator (3)."

Next, the process in step S4 is performed. The deck in this case is the top deck, so that only the number of decks is incremented by "1," and the number of decks becomes 3. In step S5, the number of decks is 3, greater than the maximum number of decks "2," so that next, the number of elevators is incremented by 1 at step S6 and is designated elevator (4).

Next, at step S7, it is determined whether the elevator is less than the maximum number of elevators. At this point, the number of elevators is 4 and it exceeds the maximum number of elevators "3." Thus, at step S8 (deck determination processing), the deck with the optimal response suitability index is determined from among the response suitability indices for the decks of all the elevators that have been found in the aforementioned way. In practice, the deck with the optimal response suitability index is the deck with the largest response suitability index, for example.

When processing according to the flowchart of FIG. 5 is performed in the system with the constitution shown in FIG. 4, with the elevators represented by "(1), (2), and (3)" and the decks by "top and bottom," the response suitability index for the decks of all the floors will be found in this order: "1 bottom," "1 top," "2 bottom, "2 top," "3 bottom," "3 top."

Group management and control part (30) assigns decks determined in the aforementioned way to new boarding hall calls and transmits assignment instructions to the elevators that have said decks.

Next, the actual assignment circumstances when the assignment process of FIG. 5 is applied to the system in FIG. 4 will be explained. Each symbol used in FIG. 4 is the same as the symbols used in FIG. 1. That is, the solid-line isosceles triangle pointing up represents a new up boarding hall call. The solid-line isosceles triangle pointing down represents a new down boarding hall call. The dashed-line isosceles triangle pointing up represents an up boarding hall call. The dashed-line isosceles triangle pointing down represents a down boarding hall call. The single dotted-line isosceles triangle pointing up represents a top deck response up boarding hall call. The double dotted-line isosceles triangle pointing up represents a bottom deck response up boarding hall call. The single dotted line isosceles triangle pointing down represents a top deck response down boarding hall call. The double dotted line isosceles triangle pointing down represents a bottom deck response down boarding hall call. The solid-line circle represents a top deck car call, and the dashed-line circle represents a bottom deck car call.

FIG. 4 shows an elevator (1), which has a car call to floor 7 on the top deck, is ascending near floors 3 and 4, elevator (2), which has a car call to floor 3 on the bottom deck is descending near floors 5 and 6, and elevator (3), which has a car call to floor 6 on the bottom deck, is ascending near floors 2 and 3.

All of this information is then held by group management and control part (30). It determines the assignments for decks in the following way based on the aforementioned information and transmits assignment instructions for the decks to the appropriate elevators as follows.

For an up boarding hall call on floor 5 (dashed-line isosceles triangle pointing up) Elevator (2) is descending to answer a car call to floor 3. Therefore, elevator (2) cannot be assigned. Elevator (1) and elevator (3) are both ascending to answer car calls, but the distance to floor 5 is shorter for elevator (1) (it can arrive faster) than for elevator (3). Therefore, the top deck of elevator (1) is assigned to the call represented by the single dotted-line isosceles triangle pointing up (top deck response up boarding hall call).

For a down boarding hall call on floor 6 (dashed-line isosceles triangle pointing down) elevator (2) has already descended near floor 5 and floor 6. Therefore elevator (2) cannot be assigned to the call. Elevator (1) and elevator (3) are ascending toward floor 6, but despite the fact that the distance to floor 6 is shorter for elevator (1) than for elevator (3), it already has a car call on floor 7 on the top deck, and it must respond to an up boarding hall call on floor 5 on the way, so it cannot arrive directly at floor 6. In contrast, regardless of the fact that the distance to floor 6 is farther for elevator (3) than for elevator (1), it responds to a car call on floor 6 on the top floor, so that it can arrive, directly at floor 6. Thus, the top deck of elevator (3) is assigned to respond to the call represented by the double dotted line isosceles triangle pointing down (bottom deck response down boarding hall call).

For a new down boarding hall call on floor 2 (the solid-line isosceles triangle pointing down). Since elevator (1) and elevator (3) are ascending to answer floor calls, elevator (1) or elevator (3) cannot be assigned to the call. Elevator (2) is descending, and can handle the call after responding to a car call on floor 3 with the bottom deck. Thus, the top deck of elevator (2) can be assigned to the new down boarding hall call represented by the single dotted line isosceles triangle pointing down.

In this case, it is also possible for elevator (3) to respond to a new down boarding hall call on floor 2 after it responds to the car call to floor 6 on the bottom deck and to the down boarding hall call on floor 6. With this assignment, although the response time is approximately the same compared to when the aforementioned elevator (2) responds, there is the risk that elevator (3) will respond to other new boarding hall calls and car calls after the aforementioned response to floor 6, and the possibility that elevator (2) and elevator (3) will become stuck in nearby positions. For this reason, the response time likelihood ratio and the degree of grouping discussed in connection with step S3 and illustrated in FIG. 5 will be very poor. Thus, the response suitability index for the top deck of elevator (2) found by the process shown in FIG. 5 will be the largest and the new down boarding hall call on floor 2 will be optimally assigned to the top deck of elevator (2).

As another embodiment example of the present invention, each weight W1–W5 of the weighting process in step S3 in aforementioned FIG. 5 could also be changed and set arbitrarily according to the priority of each element. For example, to assign "rapid response to a boarding hall call" the highest priority, weights W1 and W2, which are multipliers for the response time and response time likelihood ratio, could be set higher than weights W4 and W5, which are multipliers for the available car space and the degree of grouping.

Weights W1–W5 can also be set and changed arbitrarily according to a variety of circumstances, e.g., peak use times, differences in frequency of use for each floor, etc. If this is done, precisely controlled service can be realized.

The aforementioned deck determination process (step S3 in FIG. 5) is performed by finding the total of the five data elements, but the present invention is not limited in this way. A response suitability index could be found for each data element separately and compared for all decks, so that the deck with the best response suitability index could be determined, and the assignments made.

In addition, a group management and control part could also be designed to have both the functions of group management and control part (20) discussed in FIG. 1 and the functions of group management and control part (30) discussed in FIG. 4, and control could be performed.

The number of elevators is not limited to 3, but the same operation and effects as those described herein can be exhibited for a different number of elevators.

Although the preferred embodiments have been described herein, it is to be understood that the invention is not limited thereto and encompasses all embodiments that come within the scope of the following claims.

What is claimed is:

1. A control device for a double-deck elevator system having a first deck and a second deck, the control device comprising:

a group control device for assigning the first and second decks to respond to car calls from the first and second decks and boarding hall calls from a plurality of floors; and an assignment control device for determining whether a plurality of the car calls and boarding hall calls can be responded to simultaneously; and for directing said group control device to reassign the first and second decks to respond the plurality of car calls and boarding hall calls simultaneously wherein the first deck is assigned to respond to one of the plurality of car calls and boarding calls at a first floor and the second deck is assigned to respond to another one of the plurality of car calls and boarding hall calls at a second floor.

2. A control method for a double-deck elevator system having an first deck and a second deck, wherein the control method receives a plurality of car calls from the decks and a plurality of hall calls from floors and assigns the decks to respond to the plurality of hall calls and car calls, the method comprising the steps of:

determining whether a plurality of the car calls and the hall calls can be responded to simultaneously; and reassigning the decks when the control method determines that it is possible to respond to any of the plurality of the aforementioned car calls and boarding hall calls simultaneously wherein the first deck is assigned to respond to one of the plurality of car calls and boarding calls at a first floor and the second deck is assigned to respond to another one of the plurality of car calls and boarding hall calls at a second floor.

3. The control device of claim 1 wherein the assignment control device determines a response suitability for each deck based on a set of factors comprising: a predicted response time by each deck to a new hall call; a likelihood ratio of the predicted response time; an effect on the hall calls caused by responding to the new hall call; car space available for each deck; and the number of decks responding to the new wherein the assignment control device assigns a most appropriate deck to respond to the hall calls and new hall call based on the response suitability.

4. The control device for a double-deck elevator system of claim 3 wherein the assignment control device further comprises a weighting means for weighting each of the factors according to priority.

5. The control method of claim 2 further comprising the steps of:

Calculating a sum of data elements, the data elements comprising: a predicted response time by each deck to a new hall call; a likelihood ratio of the predicted response times; an effect on the hall calls caused by responding to the new hall call; car space available for each deck; and the number of elevators responding to the new hall call, in order to determine the response suitability for each deck; and Selecting the best response suitability from the response suitabilities for each deck; and, assigning the most suitable deck to respond to the boarding hall calls from each of the aforementioned floors.

6. The control method for double-deck elevator system of claim 5, further comprising the steps of assigning weights to each of the aforementioned data elements according to priority.

7. The control device of claim 1 wherein the first and second floor are adjacent floors.

8. The control method of claim 2 wherein the first and second floor are adjacent floors.

* * * * *